US006295691B1

(12) United States Patent
Chen

(10) Patent No.: US 6,295,691 B1
(45) Date of Patent: Oct. 2, 2001

(54) VAPOR CLEANING DEVICE

(76) Inventor: Chung Ming Chen, 7F-1, No. 245, Sec. 3, Roosevelt Rd., Taipei (TW)

( * ) Notice: Subject to any disclaimer, the term of this patent is extended or adjusted under 35 U.S.C. 154(b) by 0 days.

(21) Appl. No.: 09/520,635

(22) Filed: Mar. 7, 2000

(51) Int. Cl.[7] ..... D06F 71/34

(52) U.S. Cl. ..... 15/321; 15/401; 68/222; 392/403

(58) Field of Search ..... 15/320, 321, 339; 68/222; 392/403

(56) References Cited

U.S. PATENT DOCUMENTS 3,262,146 * 7/1966 Hays ..... 15/321
3,559,427 * 2/1971 Baker ..... 68/222
3,581,529 * 6/1971 Mitchell et al. ..... 392/403 X
4,327,459 * 5/1982 Gilbert ..... 15/321
4,426,857 * 1/1984 Epstein ..... 68/222
4,433,451 * 2/1984 Parisi ..... 15/321
4,696,074 * 9/1987 Cavalli ..... 15/321
5,042,108 * 8/1991 Yamazumi et al. ..... 15/326
5,400,462 * 3/1995 Amoretti ..... 15/321
5,651,161 * 7/1997 Asta ..... 15/339 X

* cited by examiner

*Primary Examiner*—Chris K. Moore
(74) *Attorney, Agent, or Firm*—Dougherty & Troxell

(57) ABSTRACT

A vapor cleaning device having a boiler installed in a case for boiling water. Water vapor is guided to a cleaning tool by a high temperature conduit having a holder. A variety of cleaning tools, and an extension piece may be attached to the holder. The extension piece includes ends that may be connected to another extension piece, the variety of cleaning tools and the holder. A strap attached to the case enables the cleaning device to be easily transported.

6 Claims, 10 Drawing Sheets

VAPOR CLEANING DEVICE

FIELD OF THE INVENTION

The present invention relates to a vapor cleaning device. A boiler is installed within a case for boiling water. Then by a high temperature tolerant conduit, the vapor is guided to a cleaning tool, and then the vapor molecules will adhere to the molecules to be cleaned so as to remove the undesired particles for cleaning.

BACKGROUND OF THE INVENTION

In cleaning, it is often that the dust or other particles must be removed by vapor for full cleaning. Moreover, in the cleaning process, many cleaning tools, such as, brushes, scrapers, etc., are necessary. The cleaning devices on the market cannot provide all these functions in one device. This will cause inconvenience in cleaning.

SUMMARY OF THE INVENTION

Accordingly, the primary object of the present invention is to provide a vapor cleaning device. A boiler is installed within a case for boiling water, water is boiled by the boiler, and then by a high temperature tolerant conduit, heat from the vapor is guided to a cleaning tool. The vapor molecules will adhere to the molecules to be cleaned so as to remove the undesired particles.

Another object of the present invention is to provide a vapor cleaning device, with a neck portion and a connecting portion applied to a holder, an extension piece, and a cleaning tool, such as a brush, a scraper, nozzle, etc. Moreover, the extension piece serves to extend the cleaning tool for cleaning a higher place.

A further object of the present invention is to provide a vapor cleaning device having a strip on the case thereof and having a compact boiler for being carried by hands or on the back.

The various objects and advantages of the present invention will be more readily understood from the following detailed description when read in conjunction with the appended drawing.

DETAILED DESCRIPTION OF THE PREFERRED EMBODIMENTS

Figure 1:
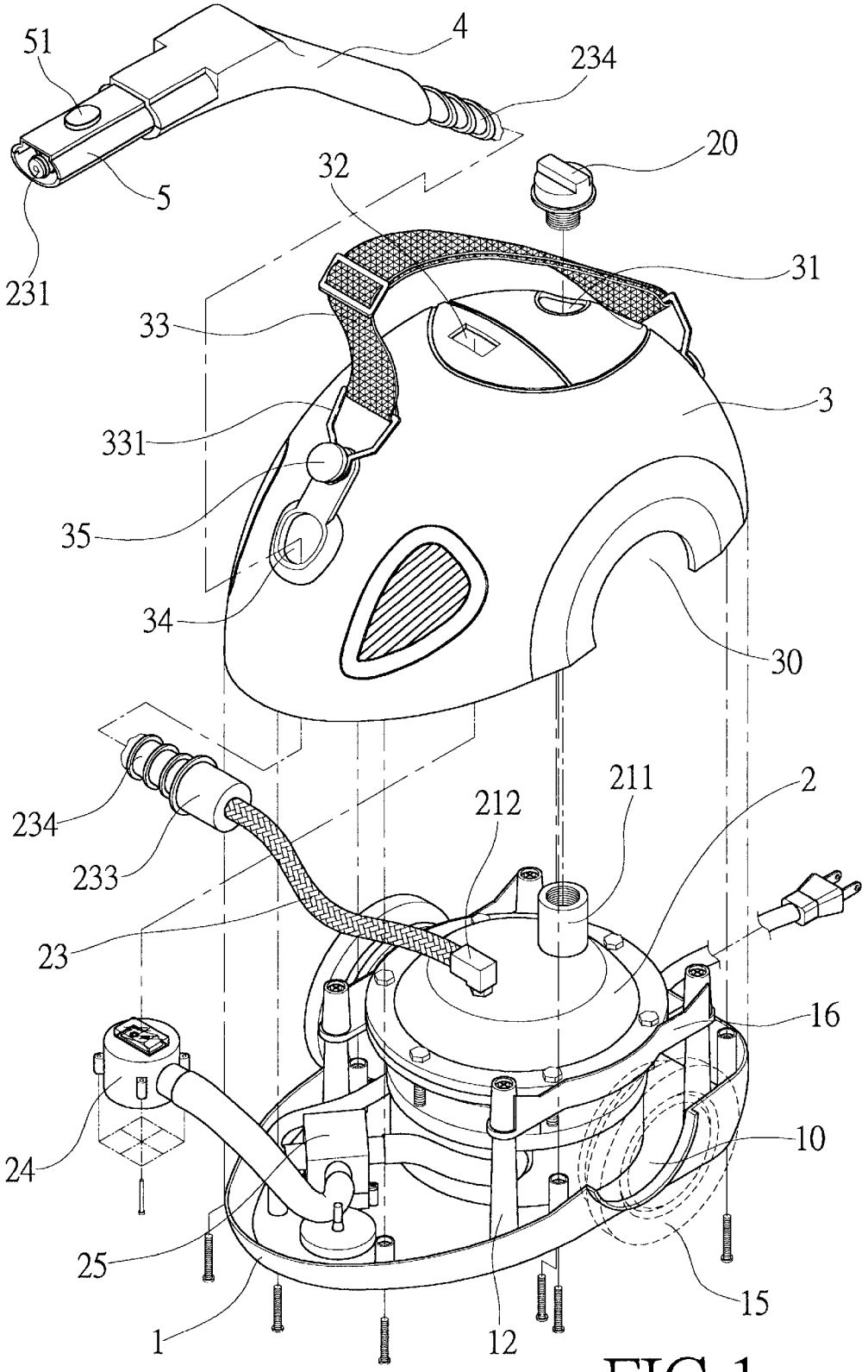
FIG. 1 is an exploded view of the present invention with an upper cover.

With reference to FIG. 1, the vapor cleaning device of the present invention is illustrated. The vapor cleaning device according to the present invention includes an upper cover 3 and a lower cover 1 forming a case, a boiler 2 within the case, and a conduit 23 connected to holder 4 and the boiler 2 through the upper cover 3. Two opposite sides of the upper cover have notches 30, respectively. The front and rear ends of the upper cover are formed with attachment buckles 35, respectively. The front buckle 35 is integrally connected to the adjacent channel 34 so that by a buckle 35, a strip 33, two ends of which have respective attachment rings 331, is connected to the case. Thus, the present invention can be carried by hands or on the back. The top of the upper cover 3 has a groove 32 with a switch and a hole 31 aligned with water post 211 for filling water.

Figure 2:
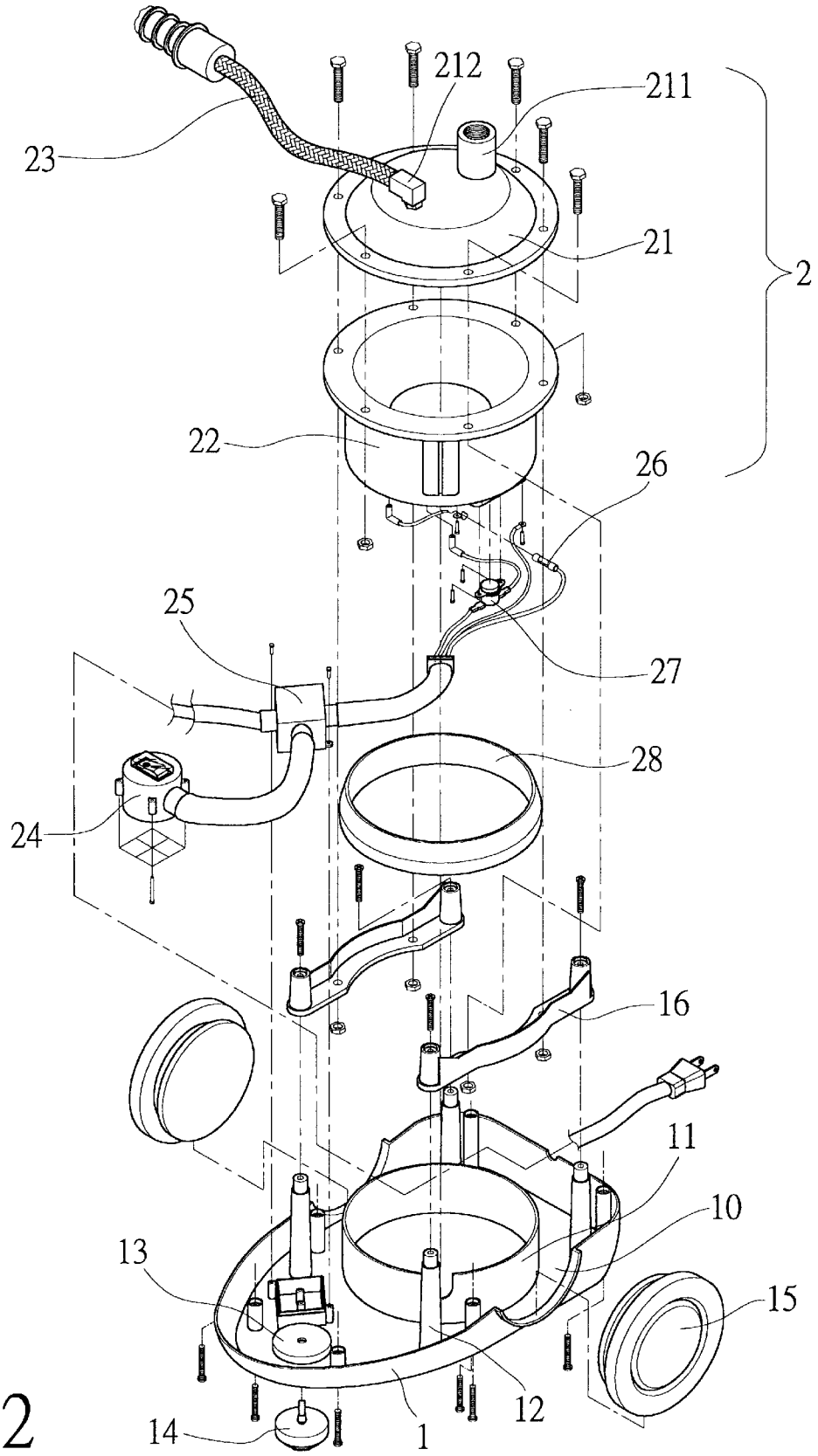
FIG. 2 is a detail exploded view of the present invention without an upper cover.

With reference to FIGS. 1 and 2, the inner bottom of the lower cover 1 has a ring shape enclosing frame 11 for receiving the boiler 2 formed by a boiler cover 21 and a boiler body 22 through screwing connection. Lower cover 1 has four positioning posts 12. An assembling post 16 runs across the upper ends of two positioning posts 12 so that two assembling posts 16 can clamp the boiler 2 in position. Two sides of the lower cover 1 have notches 10 at positions aligned with respective notches 30 in the upper cover in order that two free rotary wheels 15 can be assembled between the two notches 30 and 10. At the near end of the lower cover 1 a bottom pad 14 is installed by an enhancing block 13. A groove for receiving a line box 25 is installed near the enhancing block 13.

Figure 3:
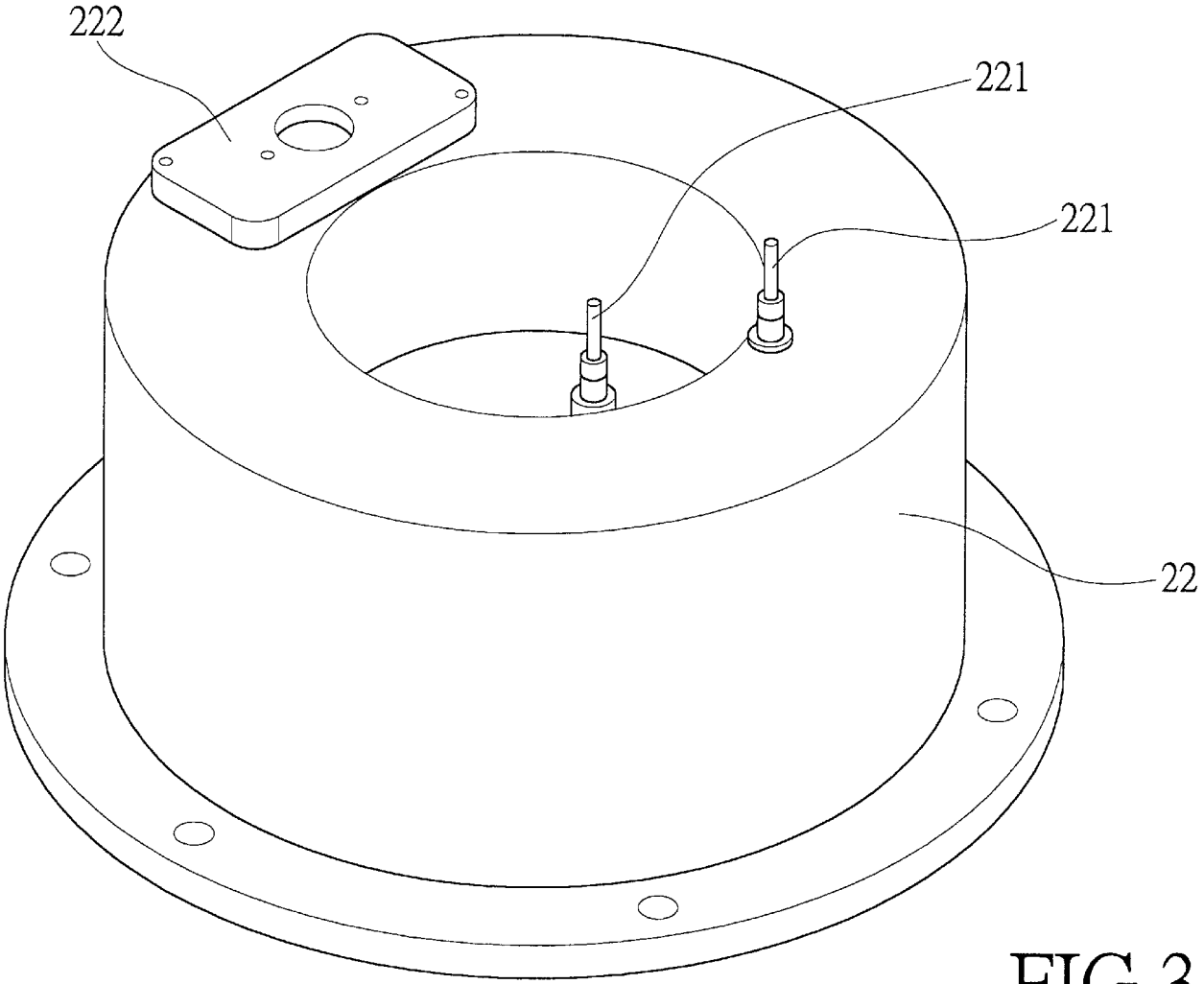
FIG. 3 is a bottom perspective view of the boiler according to the present invention.
Figure 4:
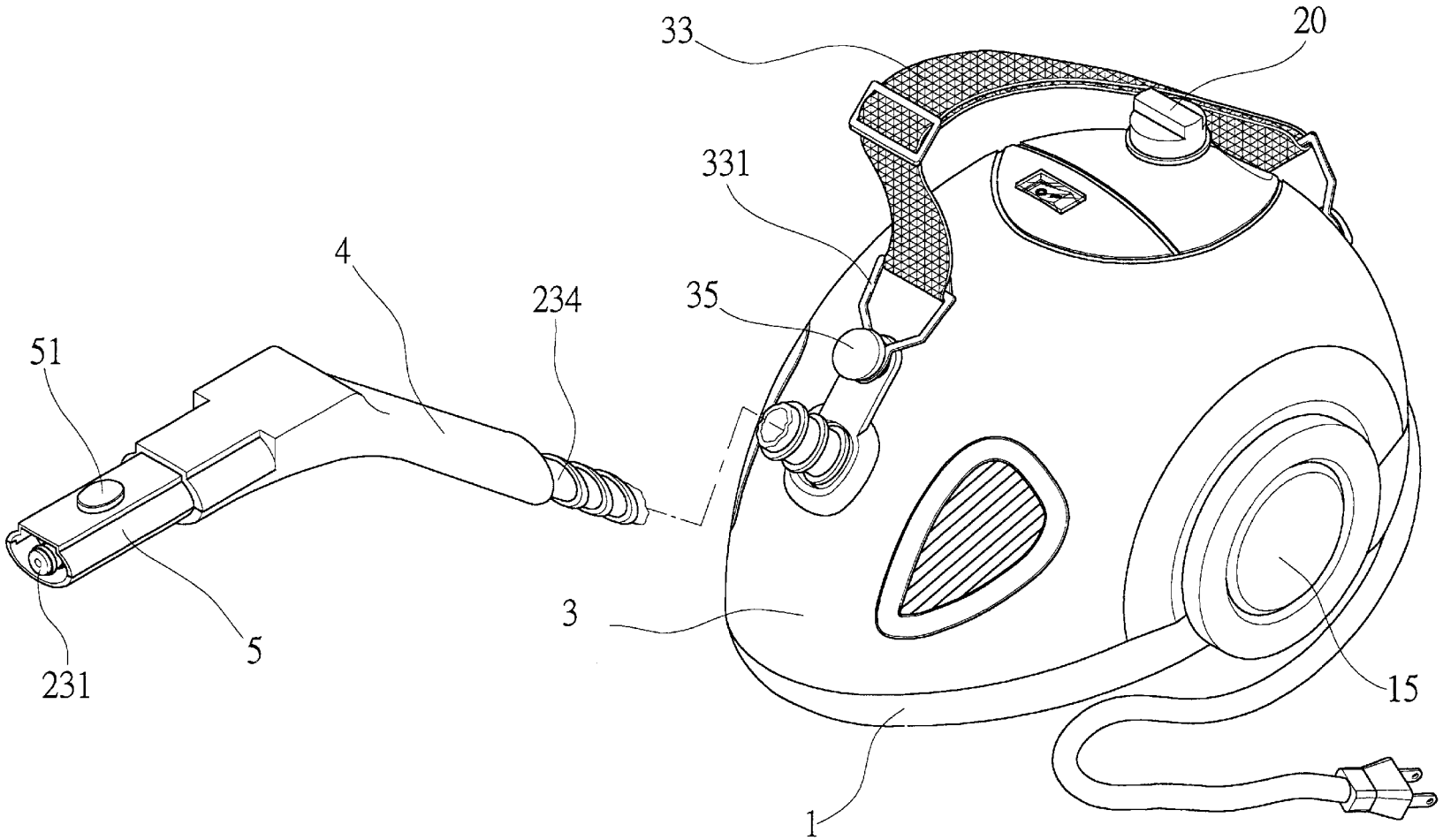
FIG. 4 is an assembled view of the present invention.

The boiler cover 21 has a water post 211 for filling water. After a proper amount of water has filled into the boiler 2, the threaded over 20 serves to cover the post. A nozzle 212 is installed at another place of the boiler cover 21 and is connected with a conduit 23 for guiding vapor outwards. With reference to FIG. 3, the bottom view of the boiler body 22 is illustrated. A round concave portion is formed at the center of the bottom. A connecting body 222 shown in FIG. 3 is installed in a non-concave place for connecting to a temperature controlled switch and fixedly installed to the bottom of the boiler body 22 as shown in FIG. 3. A silicon rubber ring is arranged between the boiler cover 21 and the boiler body 22. Ring 28 is formed with a trench for properly clamping the upper rim of the enclosing frame 11.

Figure 12:
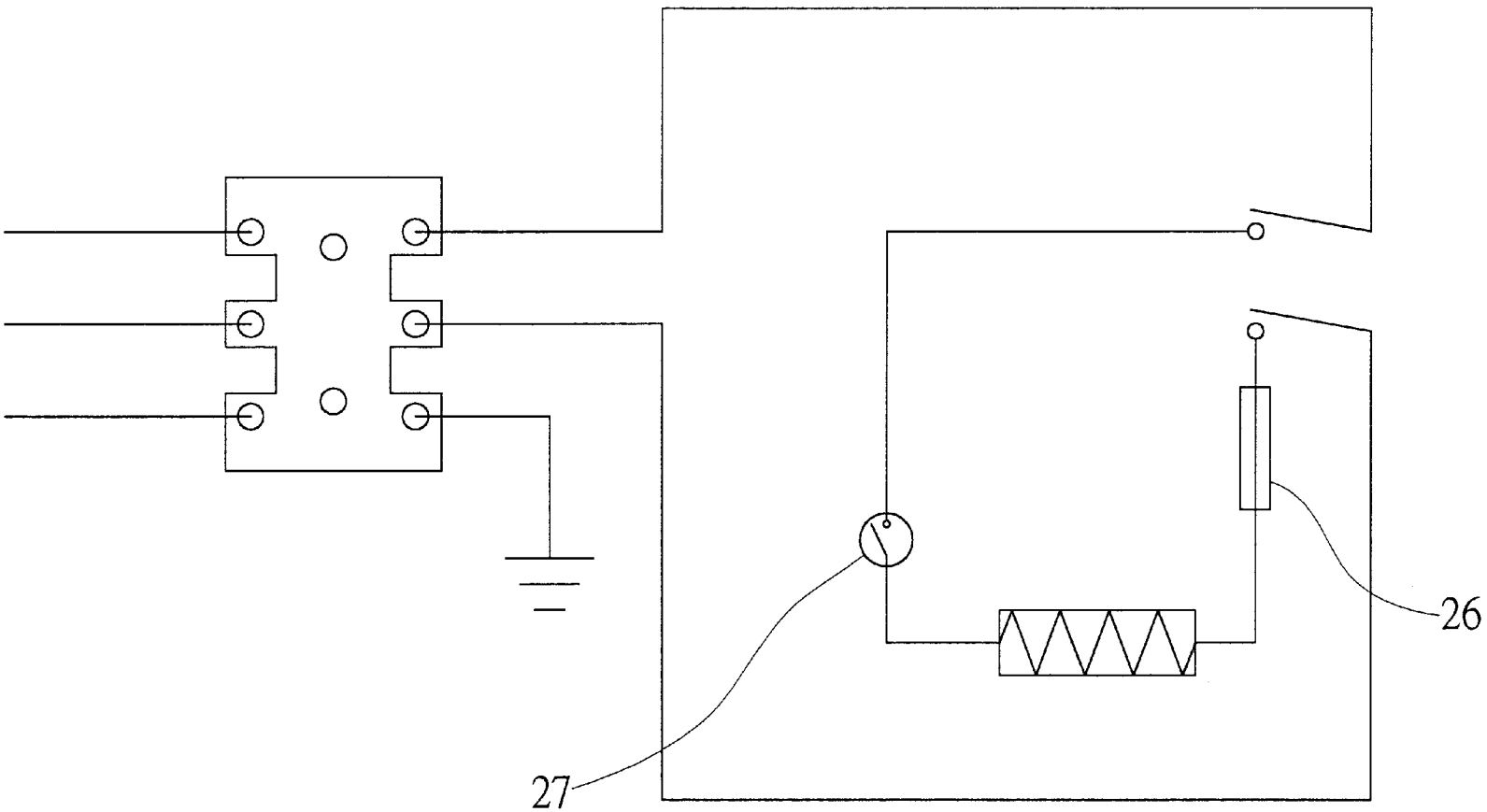
FIG. 12 shows the circuit diagram of the present invention.

The switch 24 as shown in FIGS. 1 and 2 is firmly secured to the inner top portion of the upper cover 3 of the case and protrudes through the groove 32. The switch 24 is connected to a power wire and the boiler 2 by a fuse 26 and a temperature controlled switch 27 for providing a dual protection as shown in FIG. 12.

Figure 5:
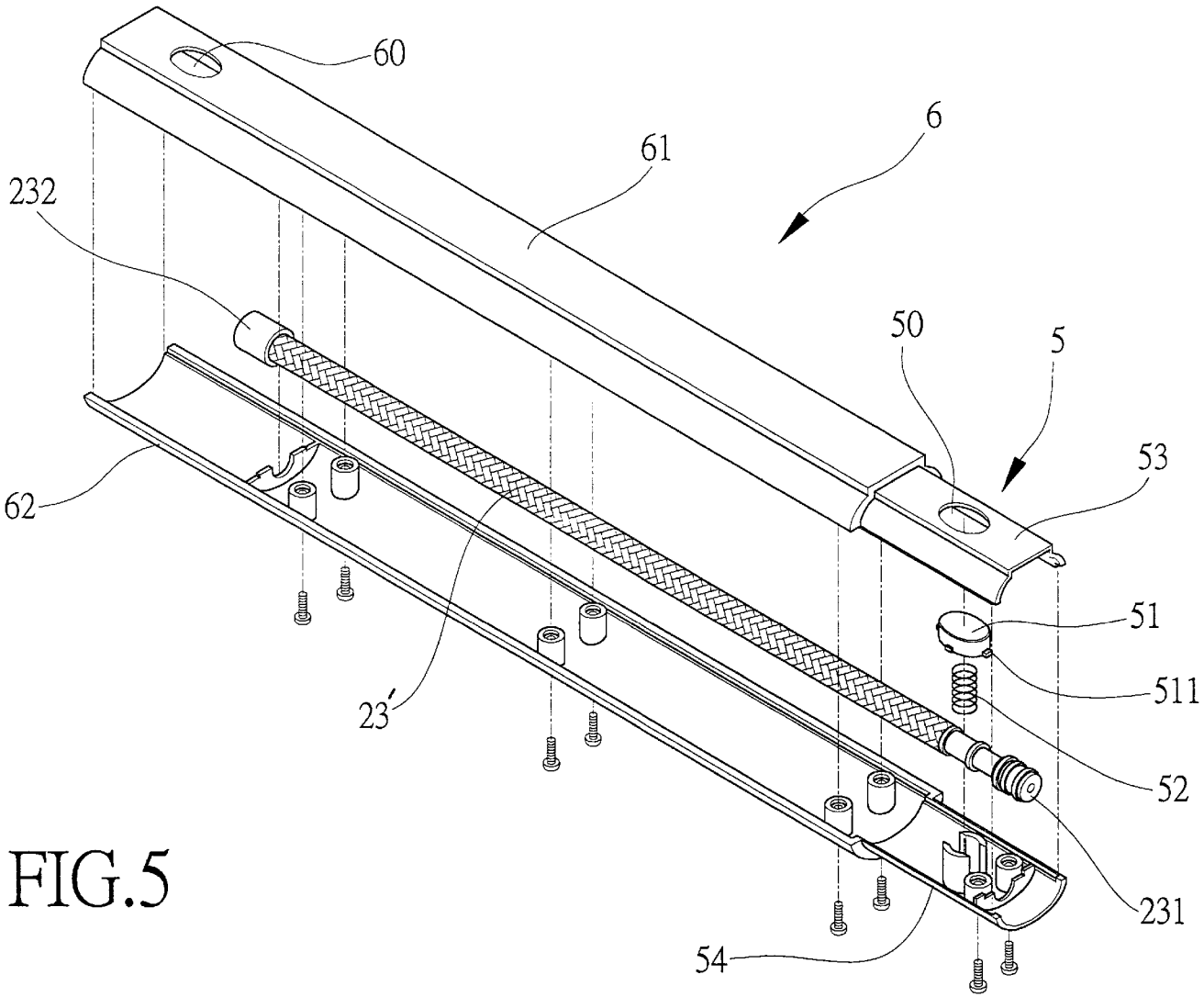
FIG. 5 is an exploded view of the extension piece in the present invention.

The conduit 23 protrudes from the opening 34 on the upper cover 3 and a buffer cover 233 is fixedly installed on the conduit 23 and in the opening 34 so as to present a buffer effect between the conduit 23 and the outer rim of the opening 34 for preventing damages to the conduit 23. An outer tube 234 for isolating heat encloses part of the conduit 23 exposed outwards. The distal end of the outer tube 234 is formed with a holder 4 held by a hand of the operator. As shown in FIG. 1, the outer end of the holder 4 is formed with a neck portion 5 for connection to a variety of cleaning tools. The distal end of the conduit 23 within the neck portion has a joint 231, as shown in FIG. 5. The upper side of the neck portion 5 has a through hole 50 and a button 51 with a plurality of protrusions 511 at the bottom. An elastic element 52 is formed between the lower side of the button 51 and the upper end of the joint 231 so that the button 51 can be telescopically moved for being connected to the cleaning device as shown in FIGS. 8–10, or an extension piece 6 disposed between the holder 4 and the cleaning device as shown in FIG. 5.

Figure 6:
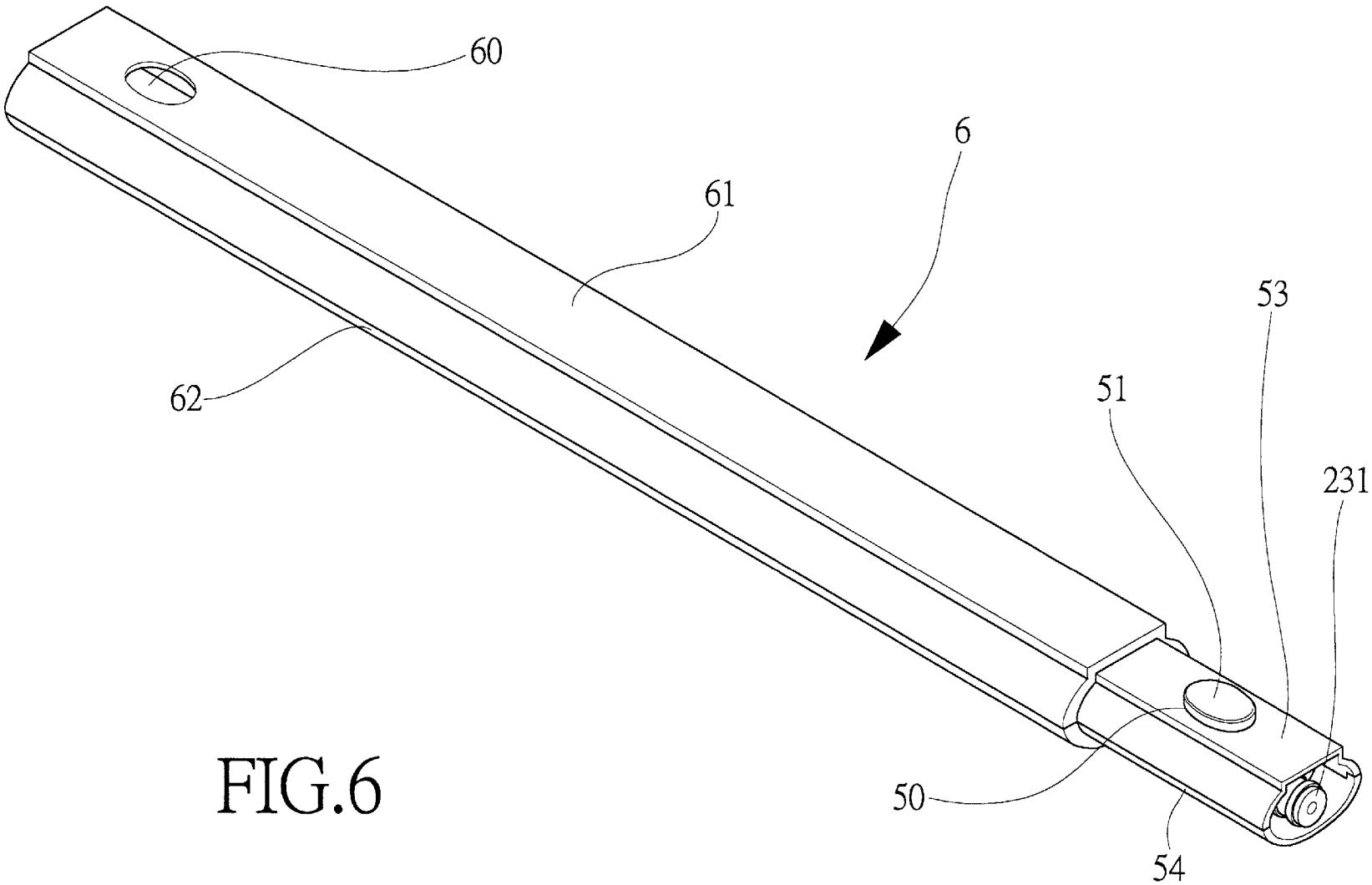
FIG. 6 is an assembled view of the extension piece in the present invention.
Figure 7:
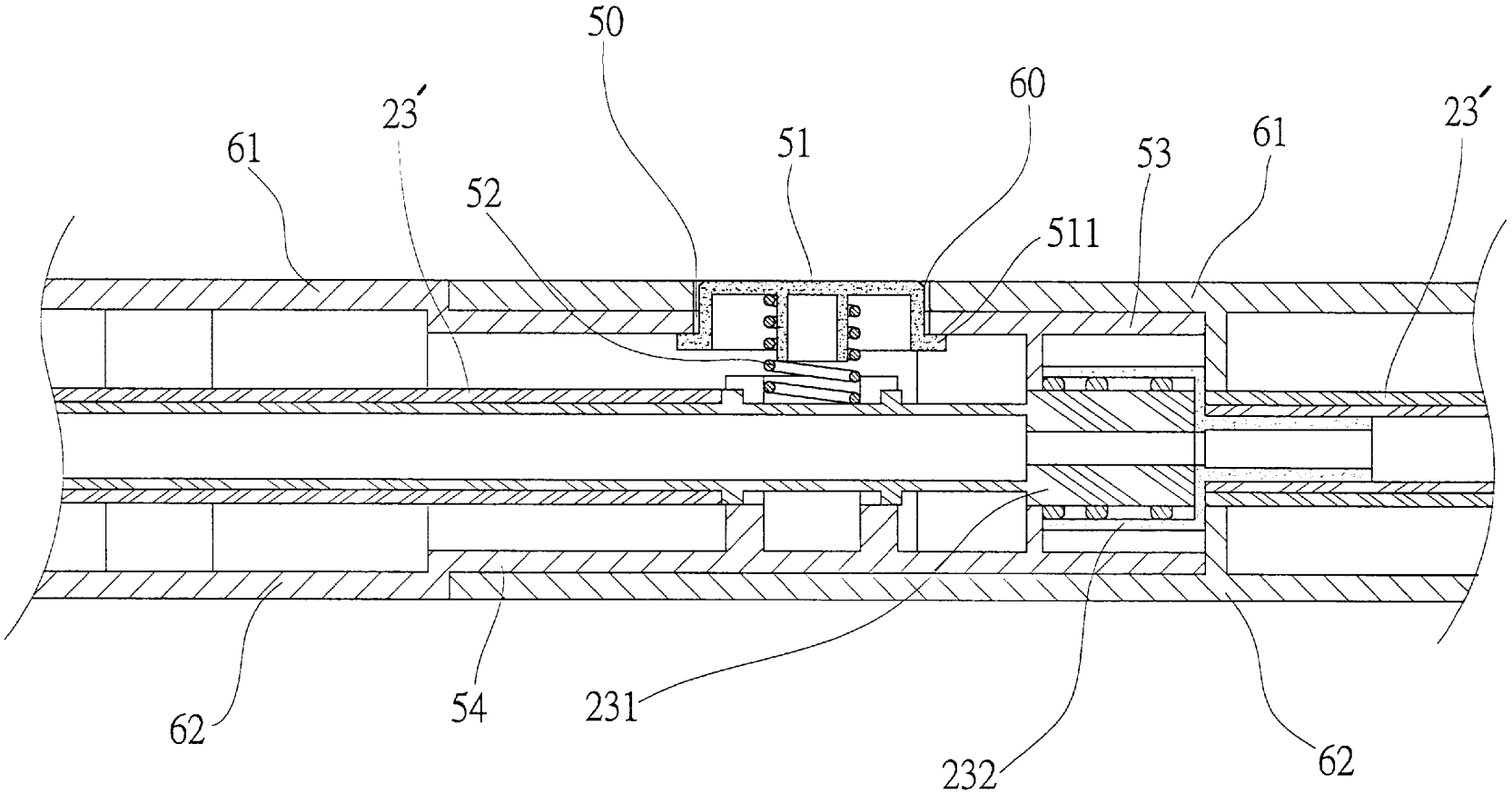
FIG. 7 is an assembled cross sectional view showing two extension pieces of the present invention being connected by the front and distal ends.

Referring to FIGS. 5 and 6, the extension piece 6 is formed by upper case 61 and lower case 62. A conduit 23' identical to the abovesaid conduit axially passes through between the upper and lower cases. The upper and lower cases 61 and 62 are formed with respective reduced upper case 53 and reduced lower case 54. After matching and assembling the reduced upper case 53 and the reduced lower case 54, the neck portion 5 is formed. The reduced upper case 53 has a through hole 50 for accommodating the button 51. The front and rear ends of the conduit 23 are connected to the joint 231 and a sleeve 232, respectively, which can be connected together. An end of the upper case 61 has a through hole 660 for receiving the button 51 of an attached extension piece as shown in FIG. 7. The neck portion 5 can be connected to a cleaning tool, an iron 74 or an extension piece 6 with a connection portion 53. In connection, the button 51 can elastically extend through the hole 60 of the connecting portion 53, while the joint 231 is received within the sleeve 232 as shown in FIG. 7.

Figure 8:
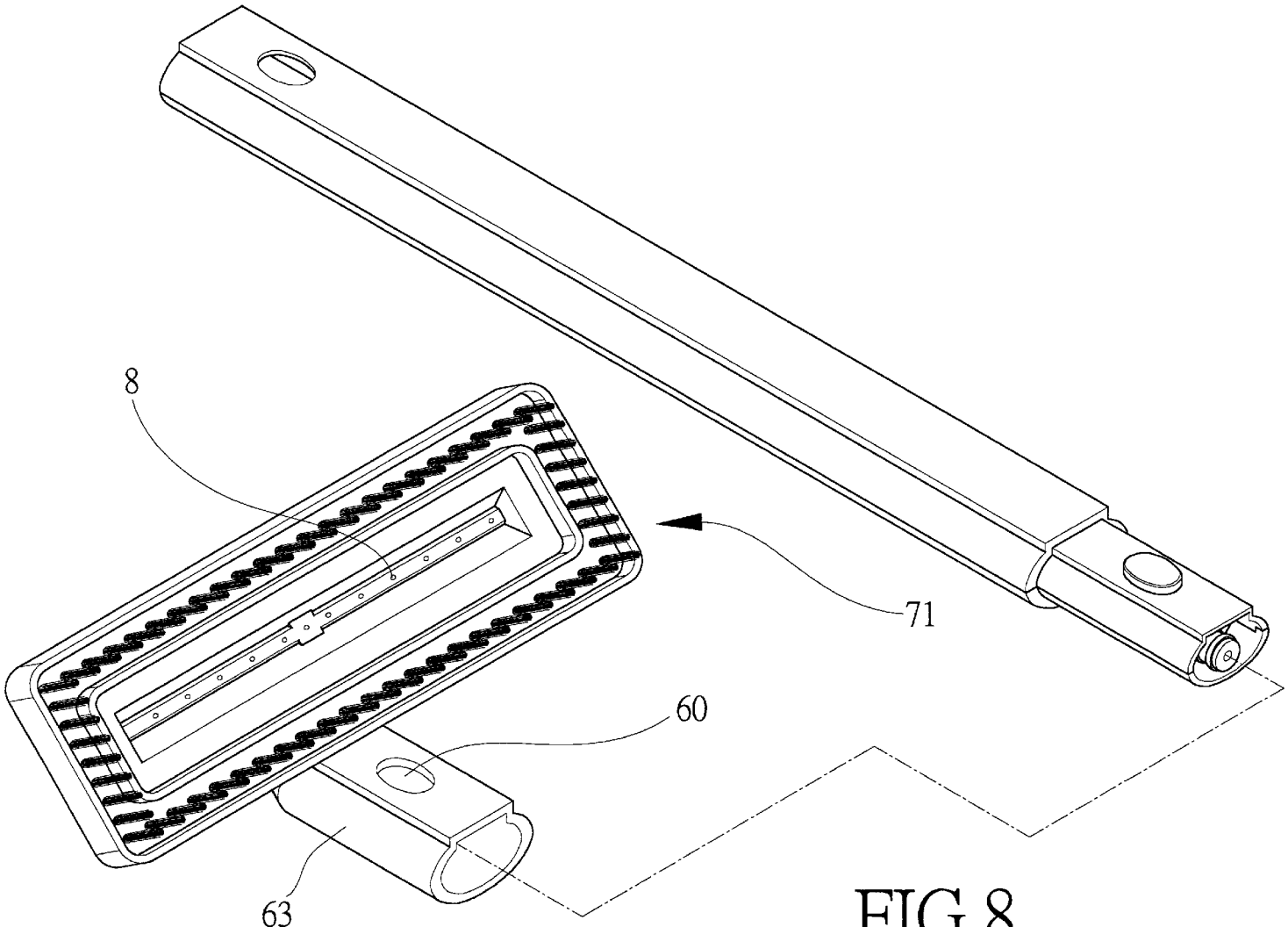
FIG. 8 is a schematic view showing that the present invention can be connected to a large brush.

With reference to FIG. 8, a cleaning tool 71 with a big brush is illustrated. The brush encloses around the plurality of jetting holes 8, and the end portion thereof is formed as a portion for being connected to the connecting portion 53. The neck portion 5 at the front end of the extension piece 6 is identical to the neck portion of the holder 4. The distal end of the extension piece 6 is identical to the connection portion 63 of the cleaning tool.

Figure 9:
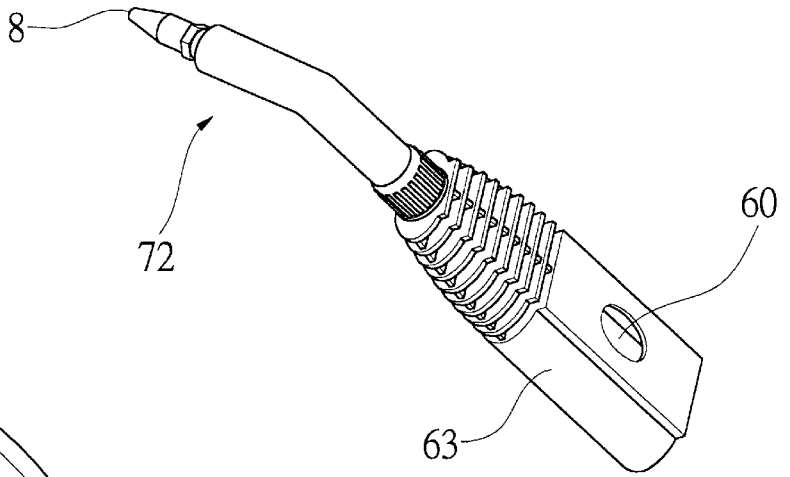
FIG. 9 is a schematic view showing that the present invention can be assembled with a nozzle tube.
Figure 10:
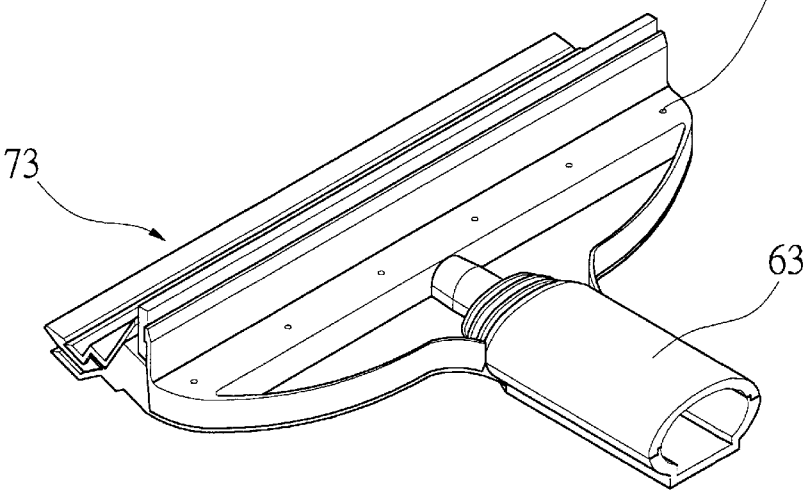
FIG. 10 is a schematic view showing that the present invention can be assembled to a scraper.
Figure 11:
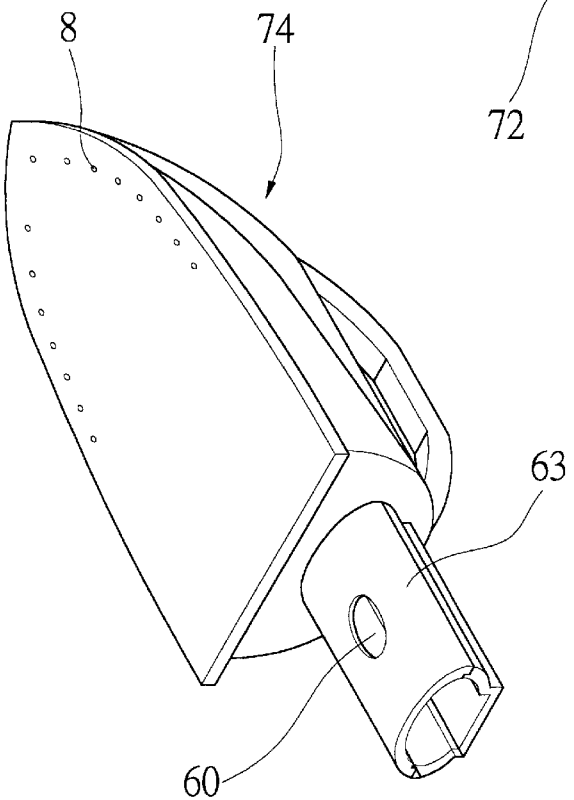
FIG. 11 is a schematic view showing that the present invention can be assembled with an iron.

With reference to FIGS. 9–11, additional embodiments of the cleaning tool and use of the cleaning tool to iron clothes are illustrated. FIG. 9 shows a jetting nozzle tube 72 which serves as a cleaning tool. The outer end of the tube has jetting holes 8 for jetting very hot vapor. Another end of the jetting nozzle tube 72 is formed as a connecting portion 63 for being connected to the neck portion 5.

As shown in FIG. 10, a scraper 73 is illustrated. The end portion of the scraper 73 is formed as a connecting portion 63 for being connected to the neck portion 5. A plurality of jetting holes 8 are arranged behind a scraping knife.

As shown in FIG. 11, the present invention can be connected to an iron 74 for ironing clothes. In the iron 74, a plurality of jetting holes 8 are arranged on the bottom of the iron 74, while the end portion is formed as a connecting portion 63 for being connected to the neck portion 5.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A vapor cleaning device comprising:

a) a case having an upper cover and a lower cover, and a plurality of wheels attached thereto, the upper cover having a carrying strip attached thereto, a channel opening and a water filling hole;

b) a plurality of spaced apart positioning posts extending upwardly from the lower cover;

c) a boiler located on the lower cover between the plurality of positioning posts, the boiler having a water filling port aligned with the water filling hole of the upper cover, a nozzle and a conduit connected to the nozzle and extending through the channel opening of the upper cover for directing vapor from the boiler;

d) a plurality of assembly posts connected to the positioning posts and engaging the boiler so as to connect the boiler to the lower cover;

e) a hand holder on the conduit, the hand holder including a neck portion with a releasable connection device adapted to releasably connect an implement thereto.

2. The vapor cleaning device of claim 1 further comprising a cleaning tool having a brush releasably connected with the hand holder.

3. The vapor cleaning device of claim 1 further comprising a jetting nozzle tube releasably connected with the hand holder.

4. The vapor cleaning device of claim 1 further comprising a cleaning tool including a scraper releasably connected with the hand holder.

5. The vapor cleaning device of claim 1 further comprising an iron for ironing clothes releasably connected with the hand holder.

6. The vapor cleaning device of claim 1 further comprising an extension piece releasably connected with the hand holder, the extension piece comprising elongated upper and lower cases joined together and housing a second conduit therein; a first end of the extension having a first connection portion including a push button and a second end of the extension including a second connection portion including a through hole in one of the upper and lower cases.

* * * * *